US005647879A

United States Patent [19]

Kubo

[11] Patent Number: 5,647,879

[45] Date of Patent: Jul. 15, 1997

[54] GRINDING MEDIA AND A PRODUCTION METHOD THEREOF

[75] Inventor: Kimito Kubo, Kashihara, Japan

[73] Assignee: Kenko Sangyo Co., Ltd., Nara, Japan

[21] Appl. No.: 298,142

[22] Filed: Aug. 30, 1994

[30] Foreign Application Priority Data

Sep. 1, 1993 [JP] Japan ..... 5-242021

[51] Int. Cl.[6] ..... C09C 1/00

[52] U.S. Cl. ..... 51/307; 51/296; 51/295

[58] Field of Search ..... 51/293, 295, 296, 51/298, 307

[56] References Cited

U.S. PATENT DOCUMENTS

| | | | |
|---|---|---|---|
| 3,925,034 | 12/1975 | Anna et al. | 51/298 |
| 4,132,533 | 1/1979 | Lohmer et al. | 51/298 |
| 4,588,420 | 5/1986 | Charvat | 51/298 |
| 4,938,784 | 7/1990 | Murakami et al. | 51/298 |
| 4,964,884 | 10/1990 | Jurissen et al. | 51/298 |
| 5,405,648 | 4/1995 | Hermann | 427/213.31 |
| 5,441,549 | 8/1995 | Helmin | 51/298 |

*Primary Examiner*—Deborah Jones
*Attorney, Agent, or Firm*—Donald S. Dowden

[57] ABSTRACT

A new grinding medium consisting essentially of a synthetic resin matrix in which small-sized foam, coarse powdery abrasives and fine powdery abrasives are dispersed is provided. A powder having a low electric resistance is added to the medium to form relatively large-sized foam around the powder. The medium is preferably produced by softening and blocking a synthetic resin powder by high-frequency dielectric heating to form a matrix of the synthetic resin and dispersing small-sized foam, coarse powdery abrasives, fine powdery abrasives and powder having a low electic resistance in the synthetic resin matrix wherein relatively large-sized foam is formed around the powder. The medium has a high ability of abrasion and the surface of the medium is smoothly renewed during the grinding process so that the medium has an excellent grinding effectiveness.

4 Claims, 3 Drawing Sheets

GRINDING MEDIA AND A PRODUCTION METHOD THEREOF

FIELD OF THE INVENTION

The present invention relates to new grinding media which are used in the barrel grinding of metal parts and the like. More particularly, the present invention relates to a new grinding medium consisting essentially of a synthetic resin matrix in which small-sized foam, coarse powdery abrasives, and fine powdery abrasives are dispersed and a production method thereof comprising softening and blocking a synthetic resin powder by high-frequency dielectric heating to form said synthetic resin matrix and dispersing said minute amount of foam, said coarse powdery abrasives, said fine powdery abrasives and powder having a low electric resistance in said synthetic resin matrix to form large-sized foam around said powders having a low electric resistance.

DESCRIPTION OF THE PRIOR ART

A barrel grinding method is a grinding method wherein workpieces are ground by a medium in a barrel which is rotated or swung.

Hitherto, a medium consisting of a synthetic resin matrix in which small-sized foam and powdery abrasives are dispersed has been provided (Tokkai Sho 60-242960).

The surfaces of workpieces are ground by powdery abrasives exposed on the surface of the medium when the workpieces are stirred with the medium in a barrel and the medium then scours the surfaces of the workpieces.

When the medium scours the surfaces of the workpieces, the media may be elastically deformed since the medium includes small-sized foam and is pressed by the workpieces while it is stirred along with the workpieces. As a result, the contacting effectiveness between the medium and the workpieces is increased by this elastic deformation of the medium.

Further, the surface of the medium is being abraded through the grinding process and the powdery abrasives within the medium are successively exposed so that the grinding effect of the medium is renewed. This renewal of the surface of the medium is called the "dressing effect".

To increase the grinding effectiveness of the medium, it is desirable to use powdery abrasives having a large particle size. Nevertheless, in a case where powdery abrasives having a large particle size are mixed in the medium, the dispersal density of the powdery abrasives may gradually decrease as the particle size of the powdery abrasives gradually increases if the added amount of the powdery abrasives is fixed. This low dispersal density of the powdery abrasives may cause unevenness of the powdery abrasives in the medium.

Accordingly, it is feared that the surface of a medium having no or less powdery abrasives is not well renewed during the grinding process. Said surface of such a medium having no or less powdery abrasives has a large number of small holes originating from the minute amount of foam and traces of the powdery abrasives peeled from the surface of the medium and the powder from the ground workpieces and grinding oil may become clogged in said small holes to obstruct the renewal of the surface of the medium so that the dressing effectiveness is decreased and as a result, the grinding effectiveness of the medium may be decreased.

SUMMARY OF THE INVENTION

Accordingly, an object of the present invention is to provide a new grinding medium in which the renewal of the surface of said medium is smoothly performed to increase the dressing effectiveness.

A further object of the present invention is to provide a new grinding medium in which less powder from the ground workpieces clogs the surface thereof.

Still a further object of the present invention is to provide a new grinding medium having an excellent grinding effectiveness.

Still a further object of the present invention is to provide a suitable production method of said grinding medium.

Briefly, said objects of the present invention can be attained by a new grinding medium consisting essentially of a synthetic resin matrix in which small-sized foam, coarse powdery abrasives and fine powdery abrasives are dispersed and a production method of said grinding medium comprising softening and blocking a synthetic resin powder by high-frequency dielectric heating to form a matrix of said synthetic resin and dispersing small-sized foam, coarse powdery abrasive, fine powdery abrasive and a powder having a low electric resistance in said synthetic resin matrix wherein relatively large-sized foam is formed around said powder.

●—● medium No. 1

○—○ medium No. 2

X—X medium No. 3

DETAILED DESCRIPTION OF THE INVENTION

Synthetic resin

Figure 1:
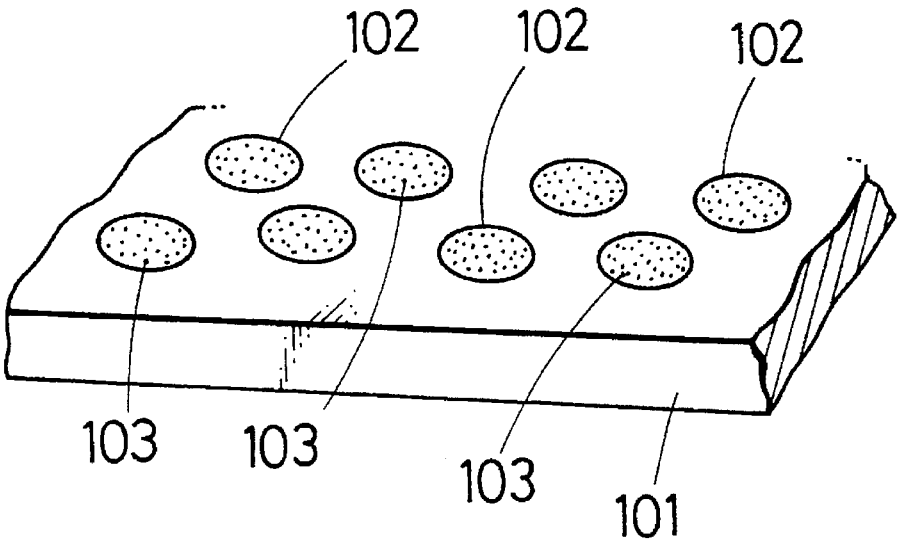
FIG. 1 is a partial perspective view of a mold panel.

In the present invention, a synthetic resin is used as a matrix for the grinding medium. Said synthetic resin is a thermosetting synthetic resin such as phenol resin, urea resin, melamine resin, epoxy resin, urethane resin and the like or a thermoplastic synthetic resin such as cellulose triacetate resin, polyvinyl chloride resin, polycarbonate resin, methacryl resin, polystyrol resin, polyamido resin (nylon 6, nylon 12 or the like), acrylonitrile-butadiene-styrene resin and the like.

Powdery abrasives

In the present invention, powdery abrasives are dispersed in the matrix of said synthetic resin. Said powdery abrasives may be ceramic powder which has been traditionally used. Said ceramic powder is such as almina powder, silica powder, zirconia powder, titania powder, boron nitride powder, silicon nitride powder and the like.

In the present invention, the coarse powdery abrasives and the fine powdery abrasives are dispersed in the matrix of said synthetic resin and the particle size of said coarse powdery abrasives is generally larger than #220 and the particle size of said fine powdery abrasives is generally less than #240.

Powder having a low electric resistance

In the present invention, a relatively conductive powder having a low electric resistance is dispersed in the matrix of said synthetic resin. The volume resistivity of said powder is generally less than $10^6$ (Ω·cm) and said powder is such as silicon carbide powder, metal powder, carbon powder and the like. The particle size of said powder is desirably close to the particle size of said powdery abrasives dispersed in the matrix of said synthetic resin.

Formulation

In said grinding medium of the present invention, the weight ratio of the matrix of said synthetic resin and said powdery abrasives is generally 40:60 to 10:90 and the weight ratio of said coarse powdery abrasives and said fine powdery abrasives is generally 30:70 to 70:30, desirably 40:60 to 60:40. In a case where said powder having a low electric resistance is added, said powder is generally added in an amount less than 10% by weight, desirably 5% by weight of the matrix of said synthetic resin.

Production method

Said grinding medium of the present invention may be produced by methods such as a method comprising the dispersal of powdery abrasives in a softened thermoplastic synthetic resin and molding said mixture by injection molding, extruding molding, casting molding or the like, or a method comprising mixing powdery abrasives in a powdery thermoplastic synthetic resin, packing said powdery mixture in a mold and heating said powdery mixture to soften and block said powdery thermoplastic synthetic resin, or the like.

In the former method, a chemical blowing agent should be added in said mixture or said mixture should be mechanically agitated to make small-sized foam in the resulting medium while in the later method, said softenend powdery thermoplastic synthetic resins stick together to form small-sized foam between said powdery thermoplastic synthetic resin.

In the later method, said powdery mixture in a mold is heated by electric heating or high-frequency electric heating. In high-frequency electric heating, it is desirable to select a thermoplastic synthetic resin as a dielectric substance having a power factor dielectrics of more than 0.02 in the range of a using frequency between 10 c/s to $10^6$ c/s to obtain a high effectiveness of the high frequency electric heating. When said powder having a low electric resistance is dispersed in the matrix of said themoplastic synthetic resin, said powder is selectively heated by high-frequency induction heating and said thermoplastic synthetic resin around said powder is selectively heated by said powder to form relatively large-sized foam around said powder.

Said relatively large-sized foam promotes the abrasion of the surface of said medium to increase the dressing effectiveness. Nevertheless, when the added amount is beyond 10% by weight of the matrix of said thermoplastic synthetic resin, it is feared that high-frequency heating cannot be performed by electric discharge.

In the present invention, a thermosetting synthetic resin is also used to form the matrix. In this case, generally, said powdery abrasives are mixed in an uncured thermosetting synthetic resin, a monomer of thermosetting synthetic; resin, an oligomer of thermosetting synthetic resin, a prepolymer of thermosetting synthetic resin and said mixture is foamed by a chemical blowing agent or by mechanical agitation and molded by cast molding to produce said grinding medium.

It is desirable to prevent the formation of a skin layer on the surface of said medium so as to expose said powdery abrasives on the surface of said medium. To prevent the formation of said skin layer on said surface of said medium, it is necessary to control the heating condition, generally the heating time, or remove said skin layer from said surface of said medium by abrasion, a solvent, or the like.

In accordance with to the present invention, the abrasion effectiveness is elevated by said coarse powdery abrasives in said medium, and the spaces between said coarse powdery abrasives are filled with said fine powdery abrasives to prevent sedimentation and separation of said powdery abrasives in said medium to acquire the uniform dispersion of said powdery abrasives in said medium, and further, said fine powdery abrasives are easily peeled from the surface of said medium so that said surface of said medium is smoothly abraded and renewed to maintain an excellent dressing effectiveness.

Further, in a case where said powder having a low electric resistance is used, when the mixture of the thermoplastic synthetic resin and said powdery abrasives and said powder are heated by high-frequency dielectric heating to soften and block said thermoplastic synthetic resin, relatively large-sized foam is formed around said powder and as a result, the dressing effectiveness is elevated.

When said high-frequency dielectric heating is applied to heat said mixture, the heating time in the mold process is shortened.

EXAMPLE 1

A mixture of nylon 6 powder and alumina powder (25:75 weight ratio) was prepared. Said alumina powder as a powdery abrasive consisted of 45 parts by weight of coarse alumina powder (average particle size being #150) and 55 parts by weight of fine alumina powder (average particle size being #600).

As shown in FIG. 1, said mixture (103) was poured into each molding hole (102) of a mold panel (101) and said mold panel (101) was put between electrodes to heat said mixture in each molding hole (102) by high-frequency dielectric heating and said mixture was softened and blocked.

Said mold panel (101) was made of a dielectric such as synthethic resin and the desirable material for said mold panel (101) was such as polyvinylfluoride, silicone rubber and the like.

The heating conditions of said high-frequency dielectric heating were voltage: 300 to 1000 volts, frequency: 10 to $10^6$ c/s and ordinary heating time: 0.5 to 3 minutes. As above described, since said heating time was very short in the case of high-frequency dielectric heating, the synthetic resin powder incompletely melted so that small-sized foam was formed to disperse in the resulting medium and a skin layer was not formed on the surface of the resulting medium. After heating, the mixture (103) in the molding holes (102) of said mold panel (101) were lightly pressed by a press mold to adjust the shape of the medium, and after cooling the resulting medium No. 1 having a diameter of 8 mm was removed from the molding holes (102) of said mold panel (101).

Figure 2:
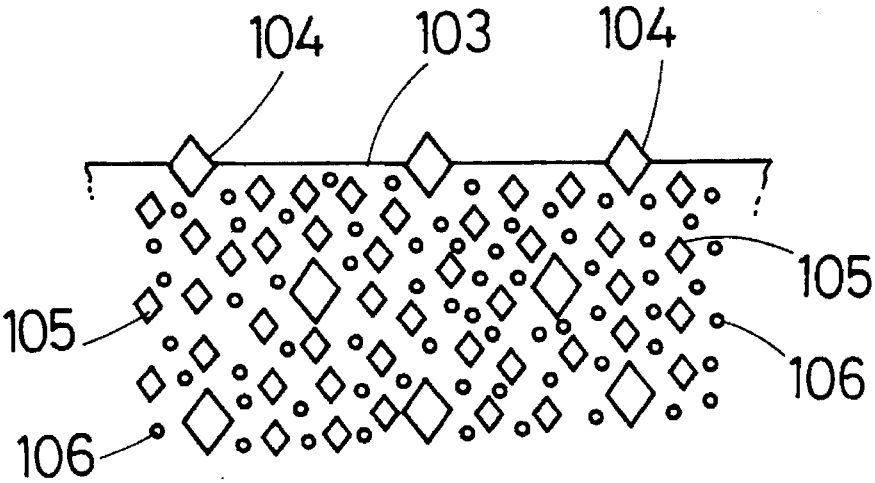
FIG. 2 is a partial sectional view of the No. 1 medium.

The structure of said medium No. 1 is shown in FIG. 2. In the Figure, (103) is the matrix of the synthetic resin, (104) is the coarse powdery abrasives, (105) is the fine powdery abrasives, and (106) is the foam.

EXAMPLE 2

A mixture of nylon 6 powder, almina powder, and silicon carbide powder (25:70:5 weight ratio) was prepared. The average particle size of said silicon carbide powder as a powder having a low electric resistance was #600 and said almina powder as a powdery abrasive consisted of 45 parts by weight of coarse almina powder (average particle size being #150) and 55 parts by weight of fine almina powder (average particle size being #600).

Media No. 2 having a diameter of 8 mm was produced from said mixture by the same method as in EXAMPLE 1.

Figure 3:
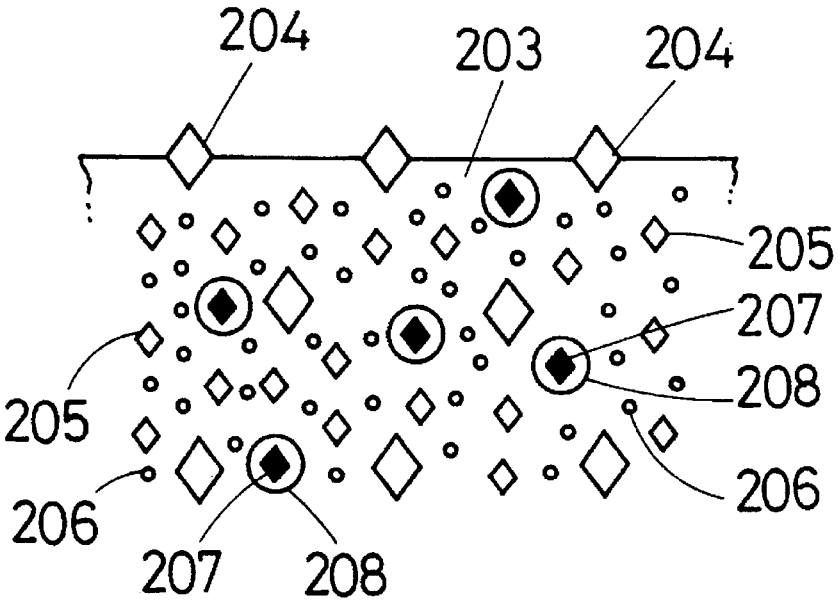
FIG. 3 is a partial sectional view of the No. 2 medium.

The structure of said medium No. 2 is shown in FIG. 3. In the Figure, (203) is the matrix of the synthetic resin, (204) is the coarse powdery abrasives, (205) is the fine powdery abrasives, (206) is the foam, (207) is the silicon powder, and (208) is the relatively large-sized foam formed around said silicon carbide powder (207).

COMPARISON 1

Medium No. 3 was prepared by using a mixture of nylon 6 and coarse powdery abrasives (25:75 weight ratio) and said coarse powdery abrasives had a particle size of #150. The production method of said medium NO. 3 was the same as in EXAMPLES 1 and 2.

TESTS

Surface roughness Rmax, average surface roughness Ra, medium abrasion easiness (dressing ability) and work grinding tests on medium No. 1, No. 2 and No. 3 were carried out.

The resulting surface roughness Rmax and Ra are shown in Table 1.

TABLE 1

| Media | $R_{max}$ (μm) | $R_a$ (μm) |
|---|---|---|
| No. 1 | 6.2 | 0.92 |
| No. 2 | 7.5 | 0.88 |
| No. 3 | 7.2 | 0.90 |

Referring now to Table 1, medium No. 1 and No. 2 in which both coarse powdery abrasives and fine powdery abrasives were used, and medium No. 3 in which only coarse powdery abrasives were used have almost the same surface roughness respectively, and it is confirmed that said surface roughness is not so much effected by the addition of fine powdery abrasives.

To determine the dressing ability of each medium, each said medium was put in a barrel rotating at a speed of 420 rpm to determine the relation between the abrading amount of each medium and the treatment time. This is shown in FIG. 4.

Figure 4:
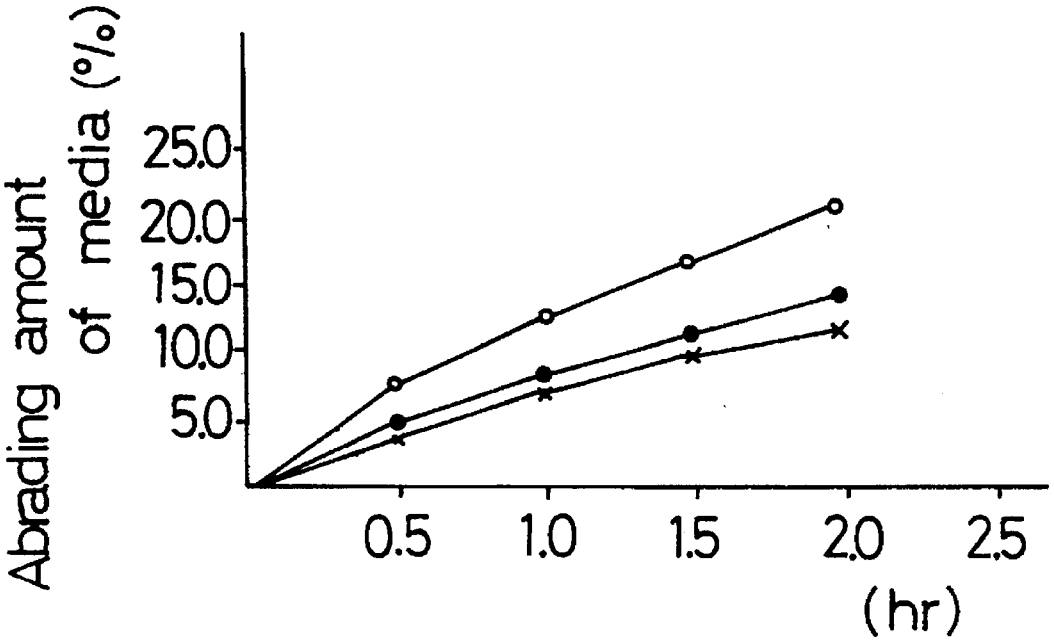
FIG. 4 is a graph showing the results of the abrasion tests on said medium.

Referring now to FIG. 4, the dressing ability of medium No. 1 and No. 2 in which both coarse powdery abrasives and fine powdery abrasives were used are larger than the dressing ability of medium No. 3 in which only coarse powdery abrasives were used, and it is remarkable that medium No. 2 in which powder having a low electric resistance was used had an especially large dressing ability.

For the workpiece grinding tests, each one of the said media was put in a barrel rotating at a speed of 420 rpm together with a workpiece (SUS 304 panel 50×20×1.2 mm) to determine the relation between the grinding amount of the workpiece and the treatment time. This relation is shown in FIG. 5.

Figure 5:
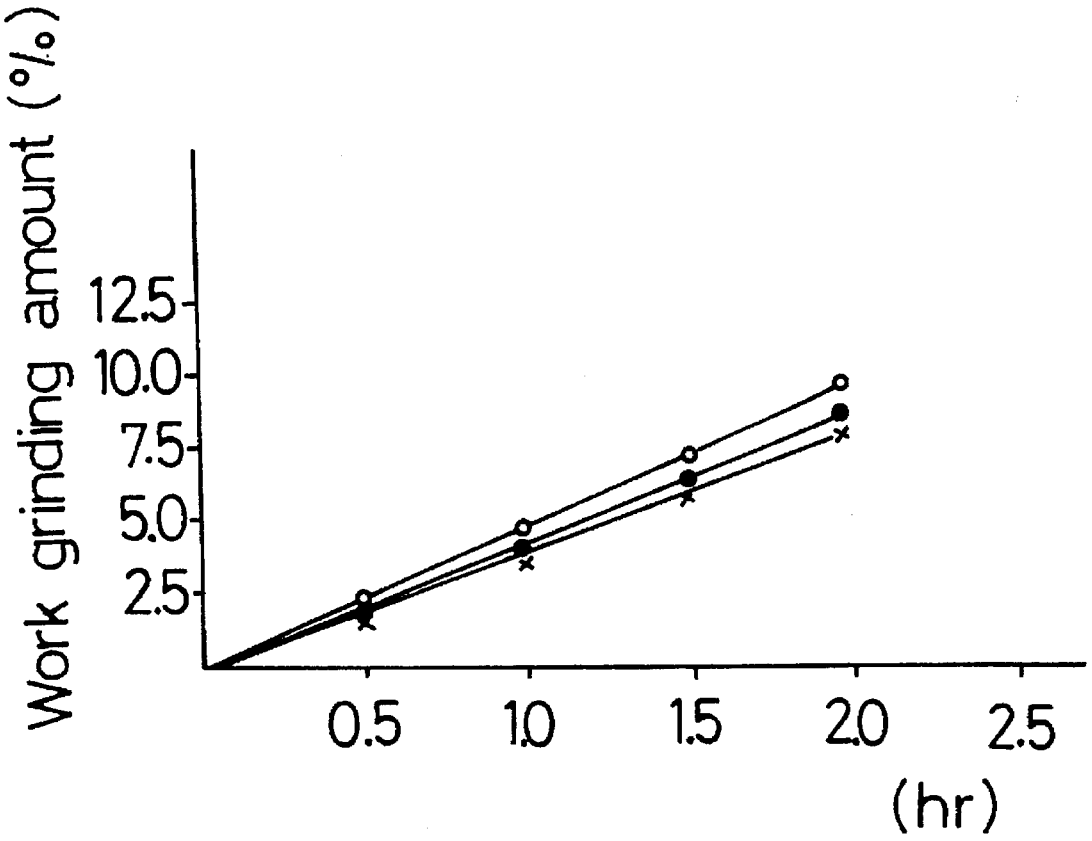
FIG. 5 is a graph showing the result of grinding tests of workpieces.

Referring now to FIG. 5, the workpiece grinding abilities of media No. 1 and No. 2 in which both coarse powdery abrasives and fine powdery abrasives were used are larger than the workpiece grinding ability of medium No. 3 in which only coarse powdery abrasives were used, and it is remarkable that medium No. 2 in which powder having a low electric resistance was used has an especially large workpiece grinding ability.

We claim:

1. A grinding medium consisting essentially of a foamed synthetic resin matrix in which coarse powdery abrasives having a particle size larger than #220 and fine powdery abrasives having a particle size smaller than #240 are dispersed, wherein the weight ratio of said synthetic resin to said abrasives is within the range of 40:60 to 10:90 and the weight ratio of said coarse powdery abrasives to said fine powdery abrasives is within the range of 30:70 to 70:30.

2. A plurality of grinding medium in accordance with claim 1 wherein said grinding medium are manufactured by a method comprising forming a mixture of a powdery synthetic resin, said coarse powdery abrasives, and said fine powdery abrasives, pouring said mixture into molding holes of a mold panel, heating said mold panel to soften said mixture to form said foamed synthetic resin matrix in which coarse powdery abrasives having a particle size larger than #220 and fine powdery abrasives having a particle size smaller than #240 are dispersed cooling the resulting medium in said molding holes of said mold panel, and removing the resulting medium from said molding holes.

3. A grinding medium consisting essentially of a foamed synthetic resin matrix in which coarse powdery abrasives having a particle size larger than #220, fine powdery abrasives having a particle size smaller than #240, and a conductive powder having an electric resistance lower than $10^6$ Ωcm are dispersed, wherein the weight ratio of said synthetic resin to said abrasives is within the range of 40:60 to 10:90 and the weight ratio of said coarse powdery abrasives to said fine powdery abrasives is within the range of 30:70 to 70:30, and wherein the conductive powder is contained in said resin in an amount less than 10% by weight.

4. A plurality of grinding media in accordance with claim 3 wherein said grinding media are manufactured by a method comprising forming a mixture of a powdery synthetic resin, said coarse powdery abrasives, said fine powdery abrasives, and said relatively conductive powder; pouring said mixture into molding holes of a mold panel; heating said mold panel to soften said mixture by high frequency dielectric heating to form said foamed synthetic resin matrix in which coarse powdery abrasives having a particle size larger than #220, fine powdery abrasives having a particle size smaller than #240, and relatively conductive powder are dispersed; cooling resulting media in said molding holes of said mold panel; and removing the resulting media from said molding holes.

* * * * *